US010092787B2

(12) United States Patent
Chen

(10) Patent No.: US 10,092,787 B2
(45) Date of Patent: Oct. 9, 2018

(54) CORRUGATED TRAMPOLINE FRAME TUBE

(71) Applicant: Samuel Chen, Kowloon (CN)

(72) Inventor: Samuel Chen, Kowloon (CN)

( * ) Notice: Subject to any disclaimer, the term of this patent is extended or adjusted under 35 U.S.C. 154(b) by 188 days.

(21) Appl. No.: 15/389,024

(22) Filed: Dec. 22, 2016

(65) Prior Publication Data

US 2017/0100619 A1 Apr. 13, 2017

Related U.S. Application Data

(63) Continuation-in-part of application No. 14/745,832, filed on Jun. 22, 2015, now Pat. No. 9,855,452.

(60) Provisional application No. 62/275,690, filed on Jan. 6, 2016.

(51) Int. Cl.

*A63B 5/11* (2006.01)
*A63B 71/02* (2006.01)
*A63B 21/02* (2006.01)

(52) U.S. Cl.

CPC ..... *A63B 5/11* (2013.01); *A63B 71/022* (2013.01); *A63B 71/023* (2013.01); *A63B 21/02* (2013.01); *A63B 2071/026* (2013.01); *A63B 2208/12* (2013.01); *A63B 2209/10* (2013.01); *A63B 2225/62* (2013.01)

(58) Field of Classification Search

CPC .... A63B 5/00; A63B 5/08; A63B 5/10; A63B 5/11; A63B 5/12; A63B 5/16; A63B 6/00; A63B 6/02; A63B 71/02; A63B 2208/12; A63B 2209/10; A63B 2225/62

See application file for complete search history.

(56) References Cited

U.S. PATENT DOCUMENTS 3,580,570 A * 5/1971 Fenner ..... A63B 5/11 482/28
3,734,496 A * 5/1973 Rubin ..... A63B 5/11 182/139
3,779,201 A * 12/1973 Spahn ..... B63B 1/047 280/206
4,037,835 A * 7/1977 Forsyth ..... A63B 5/11 248/346.5
5,385,518 A * 1/1995 Turner ..... A63B 5/11 482/23
5,637,057 A * 6/1997 Collura ..... A63B 5/11 482/27
5,810,695 A * 9/1998 Sass ..... A63B 5/11 441/37
6,053,845 A * 4/2000 Publicover ..... A63B 5/11 482/27

(Continued)

*Primary Examiner* — Garrett Atkinson
(74) *Attorney, Agent, or Firm* — Clement Cheng

(57) ABSTRACT

A trampoline has a trampoline bed, a set of trampoline springs, and a trampoline frame retaining the trampoline bed. The trampoline frame has a horizontal tube frame. The horizontal tube frame is made in sections. A corrugated upper surface is formed on the horizontal tube frame including an inside tube connected to an outside tube. An inside tube has an inside tube wave top and an outside view has an outside tube wave top. Preferably, the horizontal tube frame further includes a corrugated lower surface formed on the inside tube and on outside tube so that the inside tube has an inside tube wave bottom and the outside tube has an outside tube wave bottom.

14 Claims, 5 Drawing Sheets

(56) References Cited

U.S. PATENT DOCUMENTS

| | | | | |
|---|---|---|---|---|
| 6,447,426 | B2 * | 9/2002 | Peterson | A63B 5/11 114/311 |
| 6,508,682 | B1 * | 1/2003 | Clark | B63B 7/08 441/131 |
| 7,762,927 | B1 * | 7/2010 | Gordon | A63B 5/11 482/27 |
| 7,833,132 | B2 * | 11/2010 | Hylbert | A63B 5/11 482/27 |
| 2003/0064861 | A1 * | 4/2003 | Chen | A63B 5/11 482/27 |
| 2004/0107491 | A1 * | 6/2004 | Publicover | E04H 4/0018 4/498 |
| 2005/0054485 | A1 * | 3/2005 | McDermott | A63B 5/11 482/27 |
| 2009/0069125 | A1 * | 3/2009 | Porter | A63B 69/0097 473/435 |
| 2009/0181827 | A1 * | 7/2009 | Hylbert | A63B 5/11 482/29 |
| 2009/0260148 | A1 * | 10/2009 | Chen | E04H 4/0025 4/506 |
| 2009/0264042 | A1 * | 10/2009 | Chen | A63G 31/12 446/221 |
| 2010/0035730 | A1 * | 2/2010 | Dukart | A63B 5/11 482/27 |
| 2010/0229296 | A1 * | 9/2010 | Samuel | E04H 4/0025 4/506 |
| 2016/0030824 | A1 * | 2/2016 | Jones | A63B 6/02 482/37 |

* cited by examiner

CORRUGATED TRAMPOLINE FRAME TUBE

This application is a non-provisional of United States provisional application 62/275,690 entitled Corrugated Trampoline Frame Tube by the same inventor Samuel Chen, filed Jan. 6, 2016 the disclosure of which is incorporated herein by reference.

This application also claims priority as a continuation in part of co-pending U.S. patent application Ser. No. 14/745,832 filed Jun. 27, 2015, by the same inventor Samuel Chen, entitled Trampoline Anchor the disclosure of which is incorporated herein by reference.

FIELD OF THE INVENTION

The present invention is in the field of trampoline frames.

DISCUSSION OF RELATED ART

A variety of different trampoline frames have been made for modifying mechanical qualities of trampoline frame connections. For example, in U.S. Pat. No. 8,974,350 entitled Trampoline by inventor Hsiang, issued Mar. 10, 2015, inventor Hsiang disclosed a rebounding portion and a circular support rack, the disclosure of which is incorporated herein by reference. The circular support rack includes a left and right groove with a top ridge for improved connection. The connection method being not circular provided for increased rigidity and torsional resistance in rotation. Unfortunately, a top ridge can pose a hazard for users falling on the horizontal portion of the trampoline frame. Same inventor Hsiang also discussed in U.S. Pat. No. 5,545,110 entitled Trampoline, issued Aug. 13, 1996, that the jumping bed of a trampoline is secured to the trampoline frame by putting an elastic rubber cord through several channels around the edge of the bed and putting the cords between adjacent channels to create loops that are attached to retainer rods around the frame, the disclosure of which is incorporated herein by reference. Inventor Hsiang also discussed in Multipurpose Athletic Training Apparatus, issued Mar. 25, 1997, that there are two fastening devices for fastening the trampoline to two stands, and that the devices are adjustable between a horizontal position and a tilted position, the disclosure of which is incorporated herein by reference. In Trampoline Frame Welding Configuration, U.S. Pat. No. 7,658,697, also by Hsiang and issued on Feb. 9, 2010, the inventor discusses a trampoline frame with a main pipe with a straight line weld seam and a support pipe that are connected in a concave fashion, the disclosure of which is incorporated herein by reference. The design features an improved welding configuration that is cheap yet efficient because the weld seam on the bottom decreases shock and prevents interference between the connecting hold on the main pipe and the weld seam. It also uses a weld seam strengthening plate device. In U.S. Pat. No. 7,850,575 entitled Trampoline Surrounding Net Bracing Structure and issued Dec. 14, 2010, inventor Hsiang discusses a net bracing structure that improves connection between the trampoline and surrounding net, the disclosure of which is incorporated herein by reference. The surrounding net has a bottom rim girded around the jumping area and a top rim fastened to the bracing rack, which makes it safer. In U.S. Pat. No. 8,012,066 entitled Wire Trampoline Enclosure, issued Sep. 6, 2011, inventor Hsiang describes a wire ring that is substantially inflexible during trampoline use, and support poles that are rigidly connected to the trampoline frame. A trampoline enclosure net is suspended from the wire ring at an upper portion of the trampoline enclosure net.

Inventors Chen et al. discussed in U.S. Pat. No. 8,764,610 issued on Jul. 1, 2014 a trampoline that has a frame, protective circular net, and a jumping section, the disclosure of which is incorporated herein by reference. The frame has a circular base rack, several legs and circular net support racks on two sides of the base rack. A protective circular net is hung on the circular net support racks and held by a reinforced coupling portion which includes a holding section fastened to the flexible mat and a retaining section threaded through by at least one tightening member. The protective circular net has a lower side with several openings formed and threaded through with a tightening member to pair with the retaining section. In Convenient Multipurpose Enclosure Net Structure, patent number CN2855461Y by inventor Xiang and issued on Jan. 10, 2007, the inventor discusses a trampoline with a main frame and support poles that are connected by a structure that includes a clamping frame and locating pin. The upper and lower clamps each have a hole and each hole has a center at the same vertical axes and are of equal size. The end of the locating pin is connected with a rotating part so that the pin can be inserted and drawn easily.

A variety of different Chinese patents also disclose various trampoline frame structures. Xiang also discussed trampoline welding structures in patent number CN2855463Y, issued on Jan. 10, 2007, entitled Main Frame Welding Structure of Trampoline. The main frame tube is connected with support tube by a reinforced plate. The reinforced plate is rectangular with a hole in the center of reinforced plate. When welding, the operation is performed between the periphery of reinforced plate and central hole so that welding strength is strengthened. Inventor Shen in patent number CN201006222Y entitled Trampoline with Reinforcement Strip. The trampoline is characterized by the connection between the frame and the legs that is fixed with reinforced bars, one end of the reinforced bar is fixed on the frame while another end is fixed on the legs, which solves previous problems of trampolines with triangle or L-shaped bars.

Inventor Wang discussed in Connecting Structure for Support Rod of Trampoline, patent number CN201684336U, issued Dec. 29, 2010, a trampoline that includes a connecting structure for the supporting rod of the trampoline that is characterized by two T-shaped clamping pieces which are symmetrically combined together in the opposite directions; after the clamping pieces are combined, two transverse pieces at the upper part form a hollow transverse round tube, and two vertical pieces at the lower part form a vertical round tube; an upper bolt hole is formed on the symmetric center line of the T-shaped clamping pieces in the position of the axis of the transverse round tube; a lower bolt hole is formed below the middle part of the vertical round tube; and two bolts are arranged correspondingly into the screw holes on the clamping pieces.

Inventor Dai discusses a trampoline in patent number CN 203476852U, entitled Trampoline Connecting Member, published on Mar. 12, 2014, that uses a connecting member characterized by a T-shaped three-way pipe formed by a transverse pipe and a vertical pipe. A transverse positioning through hole is formed in a pipe wall of the transverse pipe, a vertical positioning through hole is formed in a side wall of the vertical pipe, and the T-shaped three-way pipe is formed to be of an integral structure through a die. Compared with the prior art, the trampoline connecting member has the advantages that the T-shaped three-way pipe is formed to be of the integral structure through the die, so that the whole connecting member is stronger and quite convenient to mount and carry. Although the above-mentioned prior art provides improved rigidity, it does not always do so without a decrease in durability.

SUMMARY OF THE INVENTION

The present invention is a trampoline frame and a method of making a trampoline frame. A trampoline has a trampoline bed, a set of trampoline springs, and a trampoline frame retaining the trampoline bed. The trampoline frame has a horizontal tube frame. The horizontal tube frame is made in sections. A corrugated upper surface is formed on the horizontal tube frame including an inside tube connected to an outside tube. An inside tube has an inside tube wave top and an outside view has an outside tube wave top. Preferably, the horizontal tube frame further includes a corrugated lower surface formed on the inside tube and on outside tube so that the inside tube has an inside tube wave bottom and the outside tube has an outside tube wave bottom.

A trampoline includes a trampoline frame, a set of trampoline springs mounted to the trampoline frame, and a trampoline bed held in tension by the trampoline springs. The set of trampoline springs retain the trampoline bed. The trampoline frame has a horizontal tube frame as a portion of the trampoline frame. The horizontal tube frame is made in sections including at least a first section and a second section. A corrugated upper surface is formed on the horizontal tube frame including an inside tube portion of the first section connected to an outside tube portion of the second section. An inside tube has an inside tube wave top and an outside tube has an outside tube wave top that nest together.

The inside tube wave top has an inside tube first top corner, and an inside tube second top corner. The outside tube has an outside tube first top corner and an outside tube second top corner. The inside tube first top corner engages to the outside tube first top corner. The inside tube second top corner engages to the outside tube second top corner. The trampoline frame also has a first inside tube crease that engages to a first outside tube crease and a second inside tube crease that engages to a second outside tube crease.

The inside tube wave top is aligned with the outside tube wave top and the outside tube wave top is aligned with a lower ridge that extends downwardly from a lower surface of the outside tube. The lower ridge is formed opposite the outside tube wave top. A weighted base is configured to be fluid by a liquid, and the weighted base is attached to the horizontal tube frame. The horizontal tube frame further includes a corrugated lower surface formed on the inside tube and on outside tube. The inside tube has an inside tube wave bottom and wherein the outside tube has an outside tube wave bottom.

Figure 1:
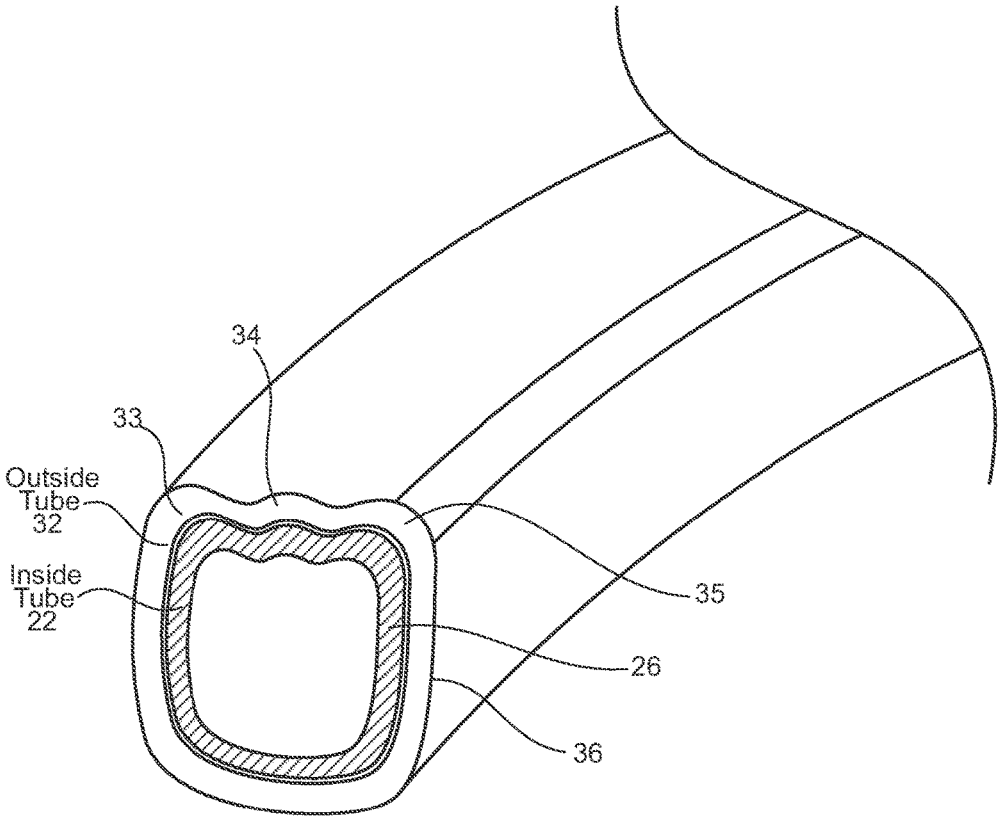
FIG. 1 is a cross-section of the horizontal tube frame 30 of the present invention.
Figure 2:
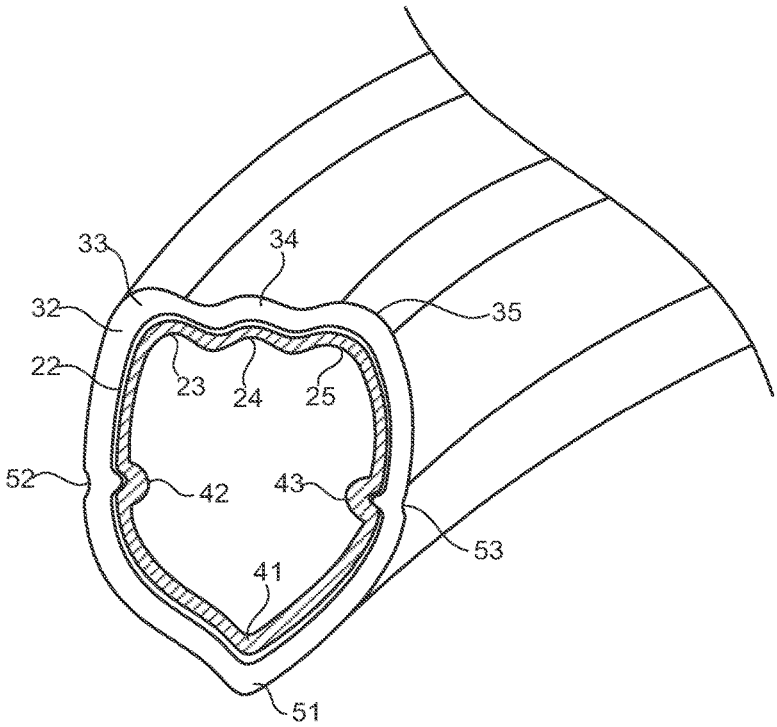
FIG. 2 is a second cross-section of the horizontal tube frame 30 of the present invention.
Figure 3:
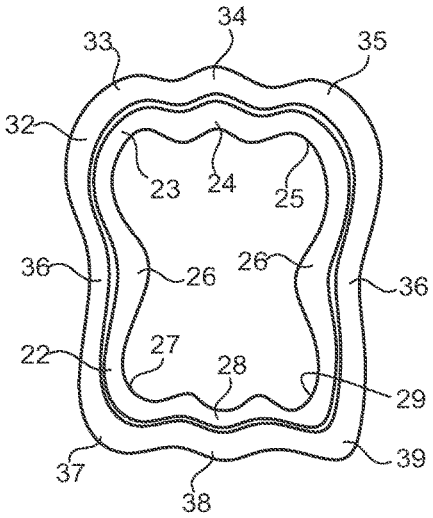
FIG. 3 is a cross-section of the horizontal tube frame 30.
Figure 4:
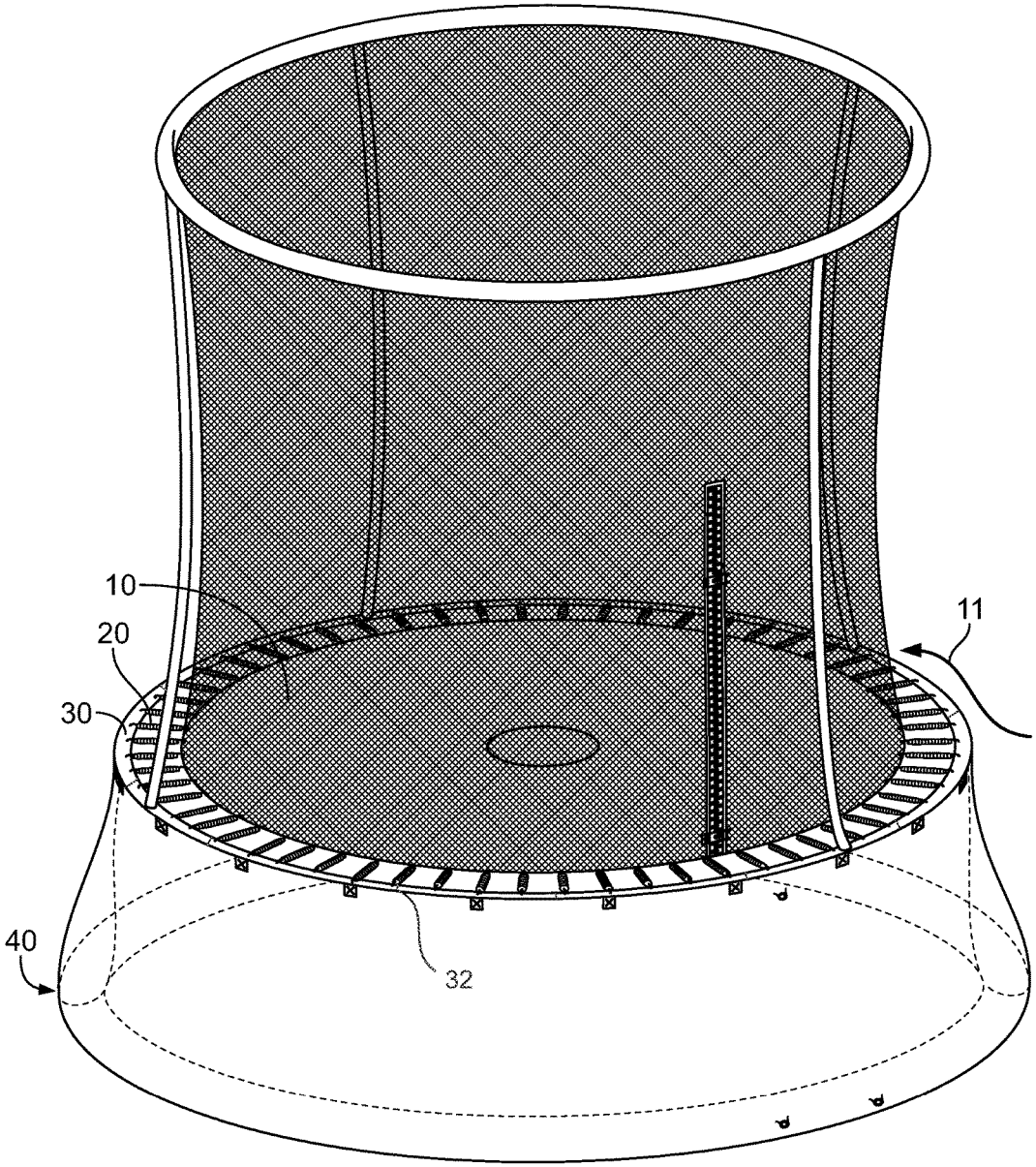
FIG. 4 is a perspective view of the trampoline.

The following call out list of elements can be a useful guide in referencing the element numbers of the drawings.

10 Trampoline Bed
11 Wind Flow
20 Trampoline Spring
22 Inside Tube
23 Inside Tube First Top Corner
24 Inside Tube Wave Top
25 Inside Tube Second Top Corner
26 Inside Tube Sidewall
27 Inside Tube First Bottom Corner
28 Inside Tube Wave Bottom
29 Inside Tube Second Bottom Corner
30 Horizontal Tube Frame
32 Outside Tube
33 Outside Tube First Top Corner
34 Outside Tube Wave Top
35 Outside Tube Second Top Corner
36 Outside Tube Sidewall
37 Outside Tube First Bottom Corner
38 Outside Tube Wave Bottom
39 Outside Tube Second Bottom Corner
40 Base
41 Inside Tube Downwardly Extending Ridge
42 First Inside Tube Crease
43 Second Inside Tube Crease
51 Outside Tube Downwardly Extending Ridge
52 First Outside Tube Crease
53 Second Outside Tube Crease
54 Socket End Of Outside Tube
55 Insertion End Of Inside Tube

DETAILED DESCRIPTION OF THE PREFERRED EMBODIMENT

Generally, a trampoline has a trampoline bed 10 suspended on springs 20 mounted to a horizontal tube frame 30. Optionally a base 40 can have a skirt that pushes wind 11 over the top of the trampoline bed 10. The horizontal tube frame 30 can be made in sections that connect together where sections have differing diameter and size to provide a telescopic connection. For example the horizontal tube frame 30 can have a first tube connected to a second tube in a telescopic horizontal configuration. The first tube can be an inside tube 22 and the second tube can be an outside tube 32.

The present invention is a horizontal section of a trampoline frame that has a wavy top design and can also have a wavy bottom. The wavy top and wavy bottom can provide a corrugated resistance to bending in the vertical direction. The corrugated top surface and alternatively the corrugated bottom surface provides bending resistance to increase the stiffness of the trampoline frame. At the same time, the connection is tighter due to the non round profile of the corrugated surfaces. The corrugated interfaces act as springs against each other to form a tighter engagement between frame sections.

The inside tube 22 preferably engages the outside tube 32 at a first and second top corner. The inside tube 22 has an inside tube first top corner 23 that engages an outside tube first top corner 33. Similarly, the inside tube 22 has an inside tube second top corner 25 that engages the outside tube second top corner.

The inside tube wave top 24 is below the outside tube wave top 34, but the inside tube wave top 24 does not engage the outside tube wave top 34. Preferably, a gap can be formed between the inside tube wave top 24 and the outside tube wave top 34, even though the two members are in a nested configuration. The inside tube wave top 24 is located between the inside tube first top corner 23 and the inside tube second top corner 25. Similarly, the outside tube wave top 34 is located between the outside tube first top corner 33 and the outside tube second top corner 35.

Optionally, the bottom surface of the horizontal tube frame 30 is also corrugated. The inside tube first bottom corner 27 can engage the outside tube first bottom corner 37. The inside tube second bottom corner 29 can engage the outside tube second bottom corner 39. The inside tube wave bottom 28 is formed between the inside tube first bottom corner 29 and the inside tube second bottom corner 39. Preferably, the inside tube wave bottom 28 does not abut or engage the outside tube wave bottom 38.

As an alternative to the bottom surface corrugation of the horizontal frame tube 30, the bottom surface can have a downwardly extending ridge where an inside tube downwardly extending ridge 41 engages an outside tube downwardly extending ridge 51. Additionally, the inside tube crease 42 can engage with the outside tube crease 52 to resist rotational motion between the inside tube and the outside tube. The outside tube downwardly extending ridge 51 can have an angled profile for receiving an angled profile of the inside tube downwardly extending ridge 41. An inside angle of the outside tube downwardly extending ridge 51 receives the outside angle of the inside tube downwardly extending ridge 41. The downwardly extending ridge has a pair of faces, namely a right face and a left face that can be at right angles to each other, for example.

Analogously, the second outside tube crease 53 can engage to a second inside tube crease 43. The second outside tube crease 53 and the second inside tube crease 43 are preferably formed on an inside radius of the horizontal frame sections. Each horizontal frame section is preferably approximately 1-2 m long and having connecting ends so that each horizontal transaction can connect to the other.

A base 40 of the trampoline apparatus can be a fluid water filled weighted chamber like a weighted anchor. A trampoline anchor is connected to a trampoline frame. A trampoline bed is attached to the trampoline frame. Trampoline springs connect the trampoline frame to the trampoline bed. A fluid chamber is connected to the trampoline frame. A fluid chamber valve allows inflation with a fluid such as water or sand. The fluid chamber valve provides a fluid chamber filling port for receiving a fluid within the fluid chamber.

Optionally, the trampoline anchor may also have an outside skirt attached to the fluid chamber, so that the fluid chamber is configured as a toroid. In a toroidal configuration, the fluid chamber may also be connected to toroidial enclosure skirt, namely an enclosure skirt weighted down by a toroidial fluid chamber that forms a windscreen for blocking air that would otherwise travel under the trampoline to create lift and drag forces. The toroidial enclosure skirt forms an outside skirt that connects between the fluid chamber and the trampoline frame at a fluid chamber skirt connection. The fluid chamber can be formed as both a toroid and as round pods with the round pods supporting the toroid. For example, the fluid chamber toroid could be made of multiple generally elongated pods.

Figure 5:
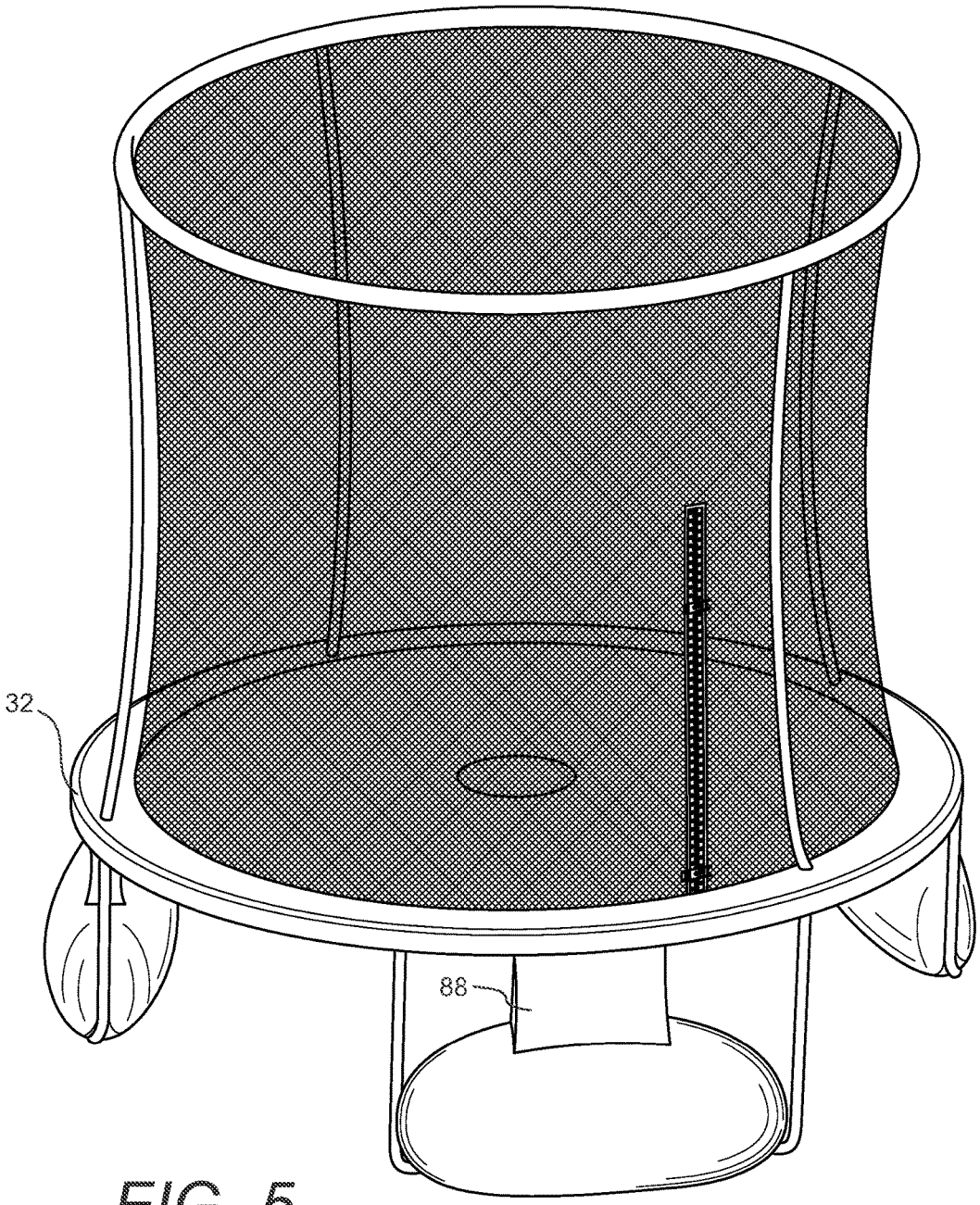
FIG. 5 is a second perspective view of the trampoline.
Figure 6:
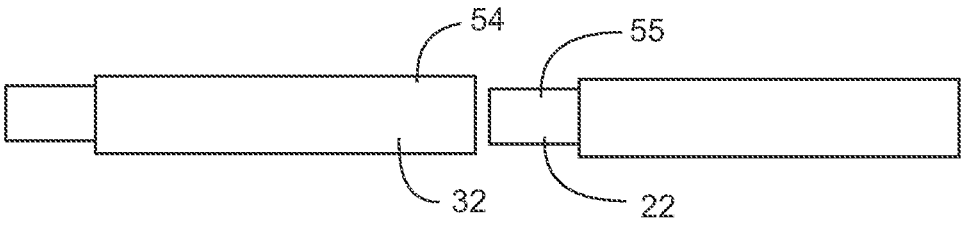
FIG. 6 is a diagram of the horizontal frame tube sections in the process of being assembled.
Figure 7:
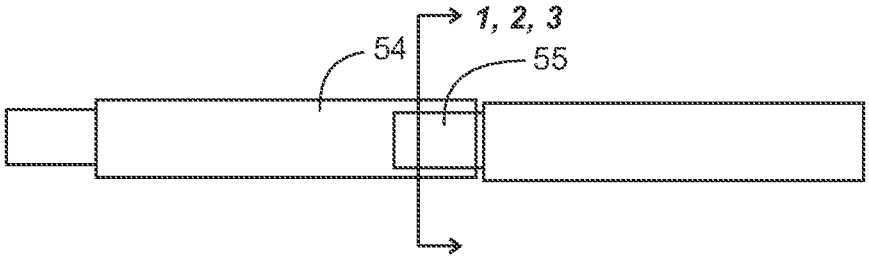
FIG. 7 is a diagram of the horizontal frame tube sections after being assembled.

The fluid chamber pods are preferably attached to legs of the trampoline and strapped to the horizontal frame member of the trampoline frame. Additionally, a ground penetrating anchor can have a loop head on a shaft. The loop head can connect to a fluid chamber pod strap. Preferably, the ground penetrating anchor is over 3 feet long in total length. As seen in FIG. 5, the fluid chamber pod strap 88 allows the fluid chamber to hang from the outside tube 32.

When the weighted base 40 is added to the trampoline frame, the increased rigidity of the horizontal frame tube 30 improves the stability of the trampoline frame. Since ground is not always perfectly level, the horizontal frame tube will be subjected to biasing force from the weighted base 40. The biasing force is loaded to the horizontal frame tube 30. Accordingly, the corrugated wave surface of the inside tube and the outside tube bend toward each other and provide a locking frictional contact for stabilizing the frame connection between the outside tube 32 and the inside tube 22. The weighted base 40 is formed as a giant water bladder that is connected to the horizontal frame tube sections such as by straps.

As can be seen from the structure of the trampoline frame, the weight of the weighted base 40 pushes down and biases the horizontal frame tube 30. The horizontal frame tube 30 is constructed by linking various sections together. Sections have sockets that receive insertion ends. Each section is made of a tube section that has a socket end and insertion end at opposite ends. The socket end is formed as the outside tube 32, and the inside tube 22 has a smaller diameter than the outside tube 32 to insert into the outside tube 32. The inside tube inserts into the outside tube with hand force, but when loaded with weight, binds to the outside tube so that the tubes do not detach from each other. The wave top corrugations are metal and have a small amount of flexibility to allow the insertion end of the inside tube to bind to the socket end of the outside tube.

The invention claimed is:

1. A trampoline comprising:

a trampoline frame;

a set of trampoline springs mounted to the trampoline frame;

a trampoline bed held in tension by the trampoline springs, wherein the set of trampoline springs retain the trampoline bed, wherein the trampoline frame has a horizontal tube frame as a portion of the trampoline frame, wherein the horizontal tube frame is made in sections including at least a first section and a second section; and a corrugated upper surface formed on the horizontal tube frame first and second sections including an inside tube portion of the first section and an outside tube portion of the second section wherein the first and second sections are configured to be connected together, wherein the inside tube has the inside tube wave top and wherein the outside tube has an outside tube wave top that nest together to form corrugated interfaces, the corrugated interfaces configured to act as springs against each other to form a tighter engagement between the first and second sections.

2. The trampoline of claim 1, wherein the inside tube wave top has an inside tube first top corner, and an inside tube second top corner.

3. The trampoline of claim 2, wherein the outside tube has an outside tube first top corner and an outside tube second top corner.

4. The trampoline of claim 3, wherein the inside tube first top corner engages to the outside tube first top corner; and wherein the inside tube second top corner engages to the outside tube second top corner.

5. The trampoline of claim 4, further including a first inside tube crease that engages to a first outside tube crease; and further including a second inside tube crease that engages to a second outside tube crease.

6. The trampoline of claim 4, wherein the inside tube wave top is aligned with the outside tube wave top and the outside tube wave top is aligned with a lower ridge that extends downwardly from a lower surface of the outside tube, wherein the lower ridge is formed opposite the outside tube wave top.

7. The trampoline of claim 4, further including a weighted base that is configured to be filled by a liquid, wherein the weighted base is attached to the horizontal tube frame.

8. The trampoline of claim 1, wherein the horizontal tube frame further includes a corrugated lower surface formed on the inside tube and on the outside tube, wherein the inside tube has an inside tube wave bottom and wherein the outside tube has an outside tube wave bottom.

9. The trampoline of claim 8, wherein the inside tube wave top has an inside tube first top corner, and an inside tube second top corner.

10. The trampoline of claim 9, wherein the outside tube has an outside tube first top corner and an outside tube second top corner.

11. The trampoline of claim 10, wherein the inside tube first top corner engages to the outside tube first top corner; and wherein the inside tube second top corner engages to the outside tube second top corner.

12. The trampoline of claim 10, further including a first inside tube crease that engages to a first outside tube crease; and further including a second inside tube crease that engages to a second outside tube crease.

13. The trampoline of claim 10, wherein the inside tube wave top is aligned with the outside tube wave top and the outside tube wave top is aligned with a lower ridge that extends downwardly from a lower surface of the outside tube, wherein the lower ridge is formed opposite the outside tube wave top.

14. The trampoline of claim 10, further including a weighted base that is configured to be filled by a liquid, wherein the weighted base is attached to the horizontal tube frame.

* * * * *